US006364974B1

(12) United States Patent
Kobasko

(10) Patent No.: US 6,364,974 B1
(45) Date of Patent: Apr. 2, 2002

(54) QUENCHING APPARATUS AND METHOD FOR HARDENING STEEL PARTS

(75) Inventor: Mykola Ivanovick Kobasko, Kiev (UA)

(73) Assignee: IQ Technologies, Inc., Akron, OH (US)

( * ) Notice: Subject to any disclaimer, the term of this patent is extended or adjusted under 35 U.S.C. 154(b) by 0 days.

(21) Appl. No.: 09/551,082

(22) Filed: Apr. 18, 2000

(30) Foreign Application Priority Data

Apr. 20, 1999 (UA) ..... 99042228

(51) Int. Cl.[7] ..... C21D 1/667; C21D 1/62; C21D 9/00

(52) U.S. Cl. ..... 148/663; 148/660; 148/637; 148/638; 148/320; 266/114; 266/259

(58) Field of Search ..... 148/663, 660, 148/638, 637, 320; 206/114; 266/259

(56) References Cited

U.S. PATENT DOCUMENTS 3,340,109 A 9/1967 Keough
3,888,471 A 6/1975 Coch
3,892,391 A * 7/1975 Okuno ..... 266/259
5,366,568 A 11/1994 Bruce

FOREIGN PATENT DOCUMENTS

RU 1703706 A * 1/1992

* cited by examiner

*Primary Examiner*—Deborah Yee
(74) *Attorney, Agent, or Firm*—James A. Hudak

(57) ABSTRACT

A quenching apparatus and a method for hardening steel parts is disclosed. The method optimizes cooling conditions preventing the occurrence of film boiling and the "self-regulated thermal process" while optimizing the depth of the hardened layer and providing increased strength for the steel part. The optimum depth of hardening is considered to be when the surface compressive stresses on the part are at their maximum value and depth. In addition, "maximum" steel strength is achieved when the cooling rate of the part is above a certain minimum level. However, additional strengthening of the part occurs when the rate of cooling avoids both film boiling and subsequent nucleate boiling, and cooling of the part proceeds directly into the convection cooling process. At the end of the quenching process, some steel parts may benefit from isothermal cooling in air, i.e., self tempering. The method causes additional strengthening of the steel part and the achievement of maximum surface compressive stresses resulting in increased service life for the part.

21 Claims, 4 Drawing Sheets

QUENCHING APPARATUS AND METHOD FOR HARDENING STEEL PARTS

BACKGROUND AND SUMMARY OF THE INVENTION

The present invention relates generally to a new and novel quenching apparatus and method for hardening steel parts. More particularly, the present invention relates to a quenching apparatus and method for hardening steel parts which achieves high strength and surface compressive stresses on all steels, including relatively low-alloy and standard carbon steels, and water and water based solutions as the quenching agent.

The quenching apparatus and method for hardening steel parts in accordance with the present invention relates generally to the heat treatment of steel parts, including carburized steel parts, steel parts heated by induction heating and other steel parts heated in electric, atmosphere, gas and vacuum furnaces. The invention has application in the metallurgic industry, including heat treating, machine construction, bearing and tool production, as well as in other branches of industry.

A steel quenching method where the depth of the quenched surface layer is controlled, which increases service life, is described in "New Induction Hardening Technology," authored by K. Z. Shepelyakovskii and F. V. Bezmenov which appeared on pages 225 through 227 of the October 1998, publication "Advanced Materials & Processes." Steel quenched using this method generally has low depth of hardened layer and fine grain with arrested growth of austenite grains at high temperatures. Due to limited hardenability, compressive stresses appear on the surface of such steel parts and the fine grain provides high strength. In addition to providing an increase in the service life of such heat treated steel parts, there is an opportunity to replace relatively expensive high-alloy steels with less expensive low-alloy steels and replace fire and environmentally dangerous quench oils with water and water based quenching solutions. However, the depth of hardness in steel parts hardened using this method is controlled by the chemical composition of the steel parts being hardened.

Steel quenching where the depth of the hardened surface layer is controlled in accordance with this method is made in water jets. The service life of such heat treated steel parts where the depth of the hardened surface layer is controlled generally increases when compared to oil quenching. However, it is often necessary to select or create an appropriate alloy of steel for use in steel parts having different configurations and sizes to obtain the effect of high surface compressive stresses.

In addition, with this quenching method no criteria exists to calculate the rate of water flow for steel parts having different configurations and/or sizes. Thus, a relatively high water flow rate is normally chosen for all steel parts which is not always justified and results in unnecessary energy expenses and makes the industrial process more complicated than necessary. While the high service life of steel parts where the depth of the hardened surface layer is controlled is considered an advantage for certain steel grades, other steel grades can also achieve the effect of increased strength (as compared to known prior art steel part quenching methods) and high residual compressive surface stresses if the heat treating parameters are properly controlled. In this method of heat treating steel, induction heating is primarily used and, to the applicant's knowledge, there is no data regarding oven heating, including such data for carburized parts, and the industrial regimes are not optimized. Thus, the heat treating method described above is entirely dependent on the composition of the steel alloys available. As a practical matter, it may be difficult to obtain steel alloys having a suitable composition. Accordingly, in practice, the hardening method should be adapted to those steel alloys which are available.

Another known prior art steel quenching method is described in "Intense Quenching" authored by Roy F. Kern and published on pages 19 through 23 in the No. 9 issue of "Heat Treating" in 1986. This known prior art steel quenching method involves "shell hardening," which results in uniform quenching of all of the surface to a certain depth until reaching high hardness using intensive jet cooling. In this method, the examples of the application of medium-carbon 1045 steel are given. One advantage of this method is the opportunity to increase the service life of steel parts using standard carbon steels, rather than alloy steels where the depth of the hardened surface layer is controlled by the composition of the steel. However, this method also has many of the disadvantages present in the previous method described. Namely, as discussed in prior publications authored by the applicant, no consideration is given to the parameters necessary to optimize the depth of the hardened surface layer, and the following correlation that the depth of the hardened surface layer should be changed for steel parts having different configurations and/or sizes is ignored:

$$\frac{\Delta\delta}{D} = \text{constant}$$

where:

$\Delta\delta$ is the optimum hardened depth; and

D is the cross-sectional thickness.

This correlation was developed by the applicant and is considered to provide a foundation for the quenching apparatus and method for hardening steel parts in accordance with the present invention.

In addition, this method does not have any criteria allowing the calculation of the optimum cooling solution quench flow and the technological process is not optimized.

Another steel quenching method is described in Japanese patent application number 61-48514 to Naito Takeshi, published Aug. 16, 1984, for a "Method of Steel Quenching" now Japanese Patent No. 59-170039. In this method, alloy steel parts are quenched in such a manner that a hard surface layer of a given depth and an arbitrarily hard matrix are obtained. For given steel grades, ranges for hardening regimes are found by experimentation to increase the service life of such steel parts. One example of this method involves an alloy steel specimen containing 0.65% to 0.85% carbon, 0.23% to 0.32% silicon, 0.4% to 0.9% manganese, approximately 2% nickel, 0.5% to 1.5% chromium and 0.1% to 0.2% molybdenum which is heated to 800° C. to 850° C. and spray quenched with water fed under a 0.4 to 0.6 MPa pressure for 0.2 to 0.8 seconds. The steel specimen is then isothermally heated at 150° C. to 250° C. for ten (10) to fifty (50) minutes. One disadvantage of this method is that it considers only high-carbon alloy steels. Also, the depth of the hard surface layer is not optimal for steel parts having different configurations and/or sizes and, because of this, steel strengthening is not consistently achieved in all parts. In addition, this method does not taken into consideration the optimization of the quenchant solution circulation rate.

A steel quenching method described in Ukraine Patent No. UA 4448, Bulletin No. 6-1, to N. I. Kobasko, in 1994, describes heating, cooling until the appearance of maximum compressive surface stresses, followed by isothermal heating (tempering). This method is based on cooling in the range of $0.8 \leqq Kn \leqq 1$, where Kn is the Kondratjev number, until reaching maximum compressive surface stresses, then isothermally heating at martensite start temperature $M_s$ until the complete transformation of the overcooled austenite of the matrix occurs and tempering. The Kondratjev number characterizes the intensity of cooling and is variable between zero (0) and one (1). It is the ratio between usual cooling and cooling when heat transfer is infinite. Therefore, even during very intense cooling, this ratio cannot exceed one (1).

One disadvantage of this method is that it deals only with alloy steels. To reach the maximum compressive surface stresses on the surface the cooling is stopped and due to this interruption in cooling, the effect of greater than normal steel strength is not fully achieved. In addition, there is no method to calculate the optimal rate of quenchant solution flow to ensure that increased strength (as compared to known prior art steel part quenching methods) is consistently realized.

Thus, in summary, an analysis of known prior art methods of steel quenching shows that steel quenching with the formation of a hard surface layer of a given depth has greater advantages than through quenching. However, a common disadvantage of these known prior art steel quenching methods is that there is no change in the optimum depth of the hard surface layer for steel parts having different configurations and/or sizes. In addition, in known prior art methods of steel quenching, the quenchant solution circulation rate is not optimized to preclude the development of "self-regulated thermal process" (when there is nucleate boiling heat transfer on the steel part surface and the steel part surface temperature is changing very slowly and is nearly constant and is close to the quenchant boiling temperature). Therefore, the steel part strength cannot be greater than the normal steel part strength. In order to provide additional steel part strengthening, the "self-regulated thermal process" should be avoided.

Accordingly, an object of the present invention is to provide a quenching apparatus and method for heat treating steel parts where the effect of increased strength (as compared to known prior art steel part quenching methods) and high compressive surface stresses are achieved for all alloy grades and standard carbon grades of steel, and lower distortion and cracking resulting from the quenching process.

Another object of the present invention is the provision of a quenching apparatus and method for heat treating steel parts which utilizes water or a water based quenchant solution rather than expensive, flammable and environmentally dangerous oil based quenchant materials.

A preferred embodiment of the present invention is, therefore, directed to a quenching apparatus and method for hardening a multitude of alloy steel parts used in, for example, metallurgy, machine construction, bearing and tool industry, quenching of carburized parts; parts heated by induction, salt bath, the usual oven heating and vacuum furnaces. Optimal cooling conditions prevent the "self-regulated thermal process" from occurring while optimizing the depth of the hardened layer and providing increased strength (as compared to known prior art steel part quenching methods) for the entire steel part. The optimum depth of hardening is considered to be when surface compressive stresses are at their maximum value and depth. In addition, "maximum" steel strength is achieved when the cooling rate is above a certain minimum level. However, additional strengthening can occur when the rate of cooling avoids both film boiling and subsequent "self regulated thermal process," and goes directly to convection cooling. This is subsequently referred to as "direct convection cooling." "Direct convection cooling" is present in the quenching operation when the Biot number is between five (5) and fifty (50). "Direct convection cooling" is maintained when there is sufficient coolant movement at the surface of the part being quenched to eliminate shock boiling, film boiling and nucleate boiling everywhere on the part's surface. At the end of the quench, some steel parts will benefit from isothermal cooling in the air (self tempering).

This process method results in additional strengthening of steel parts and maximum compressive surface stresses are achieved, resulting in increased service life of the steel parts. Relatively expensive alloy and high-alloy steels can be replaced with less expensive low-alloy or standard carbon steels. In the alternative, when using low-alloy grades of steel, such as 1010 or 1541 grades of steel, or alloy-carburized grades of steel, such as 9610 or 8620 grades of steel, the carburization cycle can be significantly reduced or eliminated entirely by hardening the steel parts using "direct convection cooling." This is because the severity of the "direct convection cooling" quench drives the hardness deeper into the surface of the steel parts and creates higher compressive stresses. Also, instead of an oil based quenching material, water or a water based solution is used. Thus, the quenching apparatus and method for hardening steel parts improves the ecological state of the environment and increases labor efficiency in hardening steel parts.

In particular, the present invention is directed to a quenching apparatus and method for hardening steel parts which includes heating the steel parts, "direct convection cooling" the steel parts until the appearance of maximum compressive stresses on the surface of the steel parts, and then self-tempering or tempering.

The required heat transfer for "direct convection cooling" on the surface of the steel parts being hardened is determined from the following formula:

$$Bi \geq \frac{2(\vartheta_0 - \vartheta_1)}{\vartheta_{Hed} + \vartheta_1}$$

where $$Bi = \frac{hR}{\lambda}$$

The Biot number, a dimensionless value;

r=The radius of the steel part;

h=The heat transfer coefficient;

$\lambda$=The thermal conductivity;

D=2R The characteristic size of the part (diameter, thickness of plate, etc.; R is the radius);

$\theta_0 = T_0 - T_K$;

$T_0$=The austenization temperature;

$T_K$=The quenchant boiling temperature;

$\theta_1$=The superfluous temperature at the beginning of "the self-regulated thermal process" (nucleate boiling);

$\theta_{Hed} = T_K - T_C$; and $T_C$=The temperature of the quenching bath.

When using "direct convection cooling," the optimum depth for the steel parts will be in the range of one percent (1%) of the part cross-sectional thickness to all the way through the part depending on the composition of the steel and the configuration and size of the steel parts being hardened. The time to interrupt the quench when surface compressive stresses in the steel parts being hardened are at their maximum is calculated using the formula:

$$\tau = \frac{K}{aKn}(b + 0.24k)$$

where

K=The Kondratjev form factor;

Kn=The Kondratjev number ($0.6 \leqq Kn \geqq 1$);

a=The thermal diffusivity;

b=A parameter dependent on the austenizing temperature of the steel parts being hardened and the cooling medium temperature;

k=1, 2 or 3 for plate-shaped, cylinder-shaped or ball-shaped bodies, respectively;

$$b = l_n \frac{T_0 - T_C}{T_{Core} - T_C};$$

and $T_{core}$=The core temperature

The presence of compressive surface stresses from using the present method is in contrast to the neutral or tensile stresses found in parts using traditional methods, such as oil and polymer/water quenchants, where the Biot number is less than five (5).

To use this formula, in most cases the "core" temperature can be estimated in the range of 400° C. to 450° C. (This temperature can be further quantified, if desired, by experimentation.) If the timing of interrupting the quench of the steel parts being hardened is off, the level of surface compressive stresses in the steel parts being hardened may be less than the potential "maximum" level of surface compressive stresses calculated and the maximum possible for the steel parts being hardened.

Other advantages and novel features of the present invention will become apparent in the following detailed description of the invention when considered in conjunction with the accompanying drawings.

DETAILED DESCRIPTION OF THE DRAWING

Figure 1:
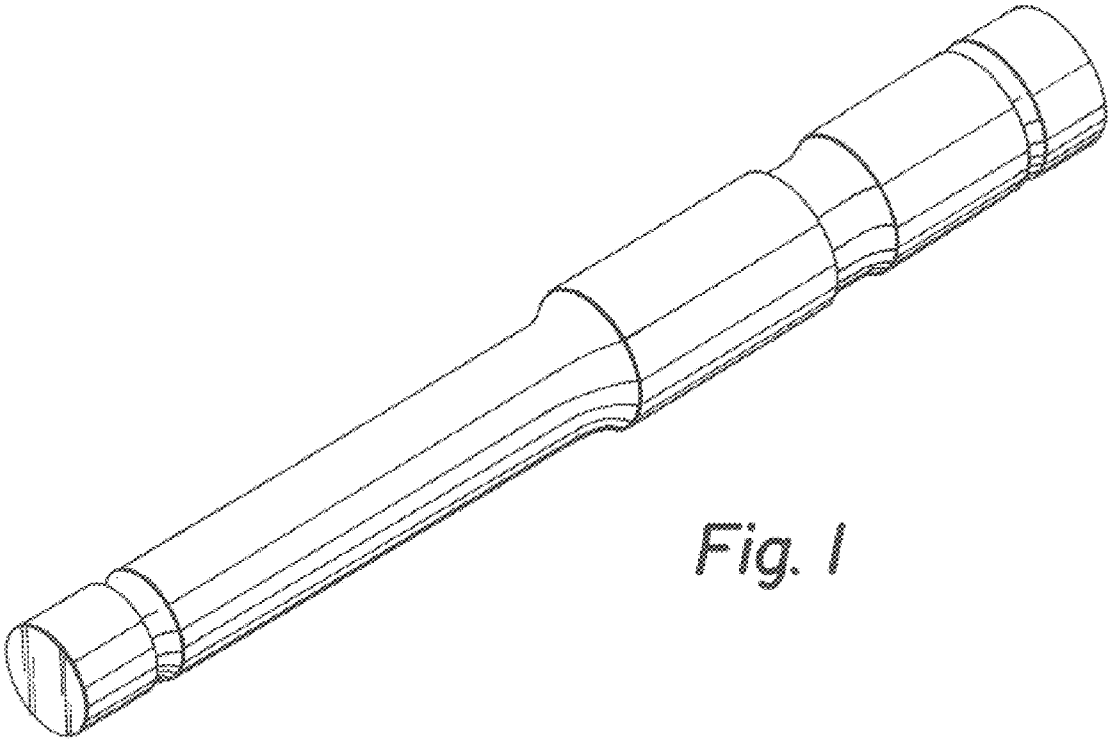
FIG. 1 is a perspective view of a punch made of molybdenum high-speed steel R6M5 (~AISI M2) which has been hardened using the quenching apparatus and method for hardening steel parts in accordance with a preferred embodiment of the present invention ("direct convection cooling").
Figure 2:
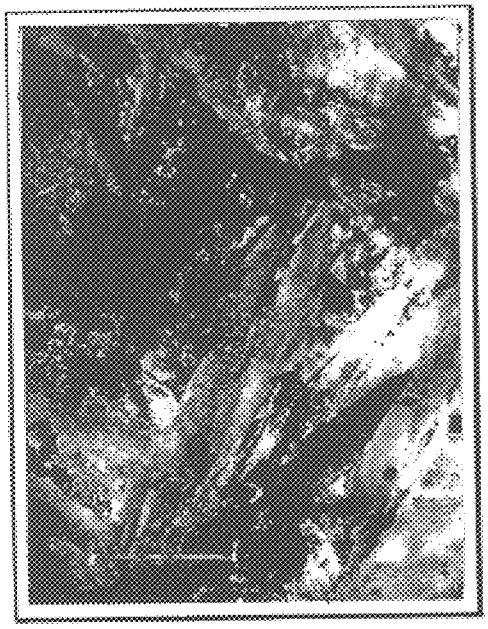
FIG. 2 is a top view of an electron photomicrograph of the punch made of molybdenum high-speed steel R6M5 (~AISI M2) which has been hardened using a conventional oil quenching method.
Figure 3:
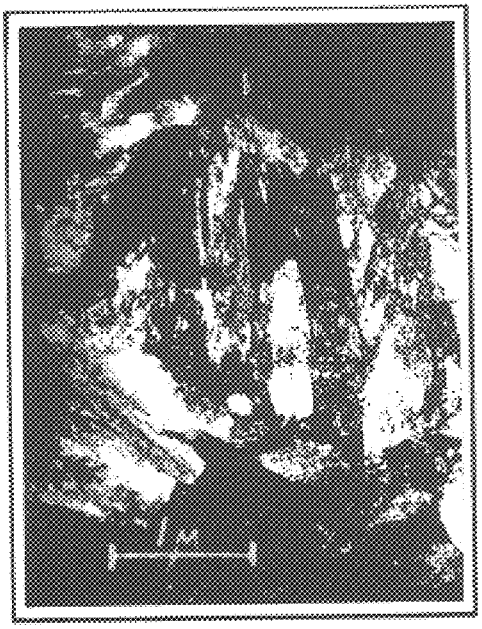
FIG. 3 is a top view of an electron photomicrograph of the punch made of molybdenum high-speed steel R6M5 (~AISI M2) which has been hardened using the quenching apparatus and method for hardening steel parts in accordance with a preferred embodiment of the present invention ("direct convection cooling").
Figure 4:
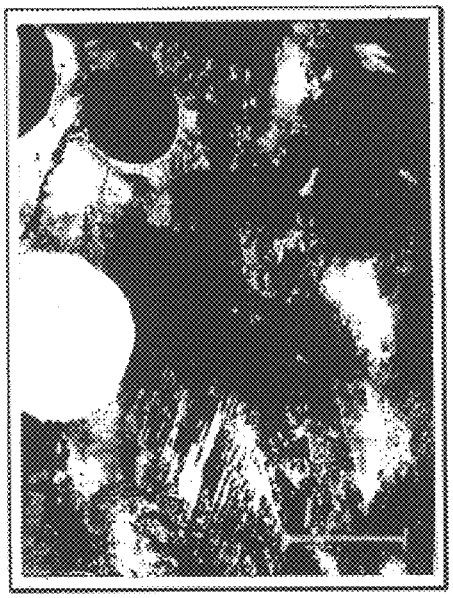
FIG. 4 is a top view of an electron photomicrograph of the punch made of molybdenum high-speed steel R6M5 (~AISI M2) which has been hardened using a conventional oil quenching method after 5,000 cycles of fatigue testing.
Figure 5:
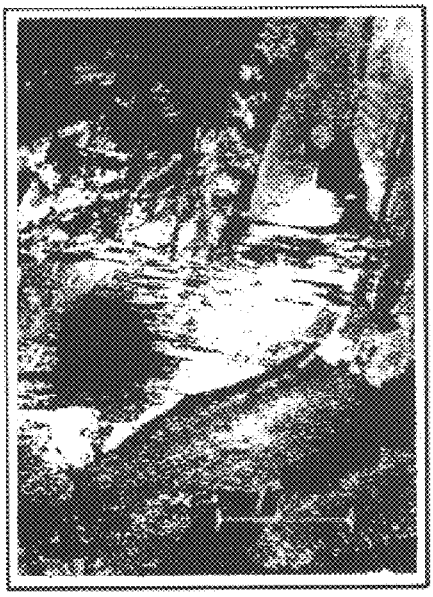
FIG. 5 is a top view of an electron photomicrograph of the punch made of molybdenum high-speed steel R6M5 (~AISI M2) which has been hardened using the quenching apparatus and method for hardening steel parts in accordance with a preferred embodiment of the present invention after 5,000 cycles of fatigue testing ("direct convection cooling").
Figure 6:
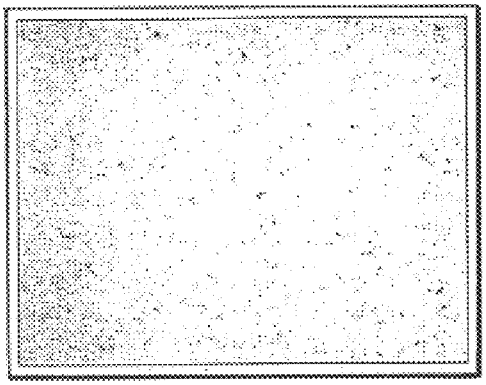
FIG. 6 is a top view of the microstructure of a representative quenched 5160 steel torsion bar segment using a conventional hardening method showing the surface of the representative quenched 5160 steel torsion bar segment contains approximately 3% bainite.
Figure 7:
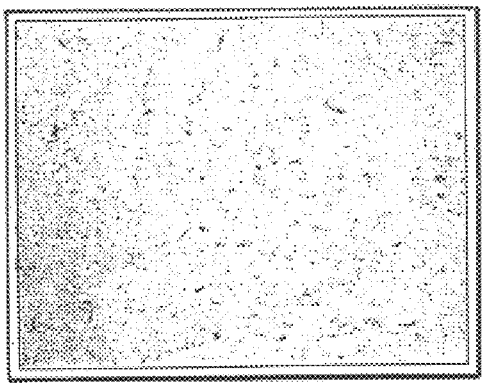
FIG. 7 is a top view of the microstructure of a representative quenched 5160 steel torsion bar segment using a conventional hardening method showing the near surface of the representative quenched 5160 steel torsion bar segment contains approximately 5% bainite.
Figure 8:
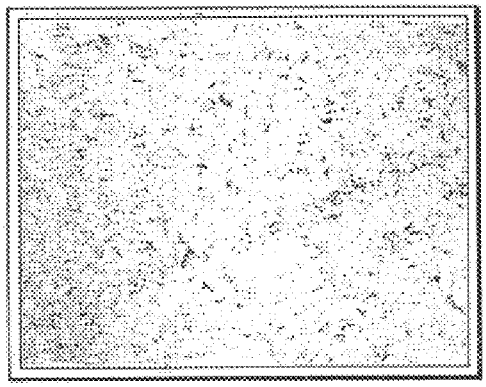
FIG. 8 is a top view of the microstructure of a representative quenched 5160 steel torsion bar segment using a conventional hardening method showing the one half (½) radius of the representative quenched 5160 steel torsion bar segment contains approximately 12% bainite.
Figure 9:
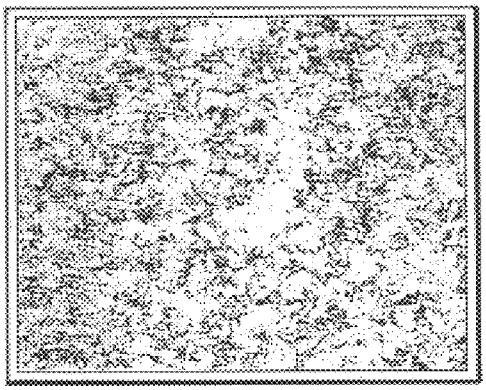
FIG. 9 is a top view of the microstructure of a representative quenched 5160 steel torsion bar segment using a conventional hardening method showing the core of the representative quenched 5160 steel torsion bar segment contains approximately 29% bainite.
Figure 10:
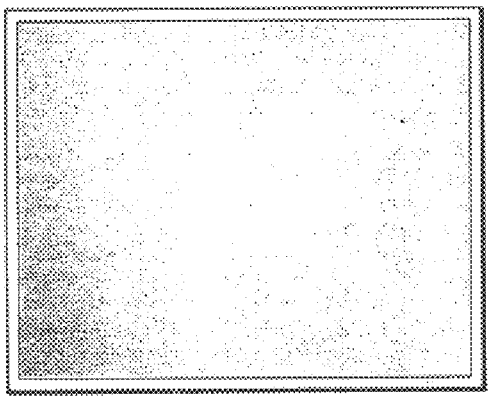
FIG. 10 is a top view of the microstructure of a representative quenched 5160 steel torsion bar segment using the quenching apparatus and method for hardening steel parts in accordance with the present invention ("direct convection cooling") showing the surface of the representative quenched 5160 steel torsion bar segment contains approximately 0% bainite.
Figure 11:
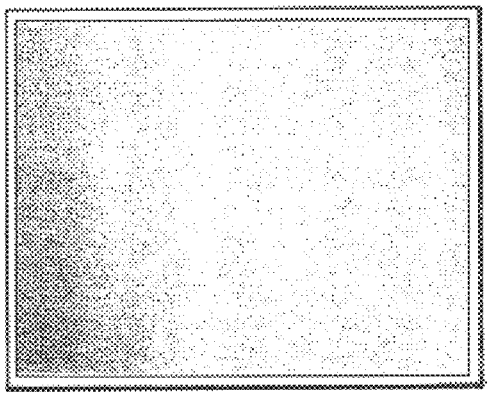
FIG. 11 is a top view of the microstructure of a representative quenched 5160 steel torsion bar segment using the quenching apparatus and method for hardening steel parts in accordance with the present invention ("direct convection cooling") showing the near surface of the representative quenched 5160 steel torsion bar segment contains approximately 0% bainite.
Figure 12:
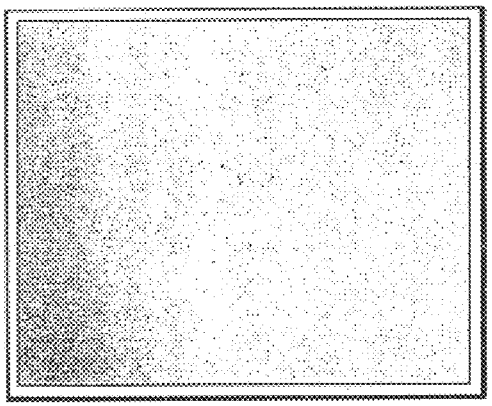
FIG. 12 is a top view of the microstructure of a representative quenched 5160 steel torsion bar segment using the quenching apparatus and method for hardening steel parts in accordance with the present invention ("direct convection cooling") showing the one half (½) radius of the representative quenched 5160 steel torsion bar segment contains approximately 2% bainite.
Figure 13:
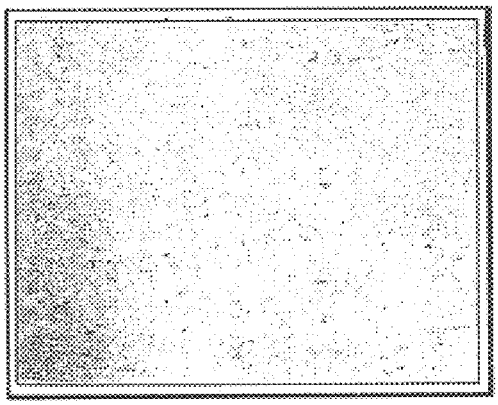
FIG. 13 is a top view of the microstructure of a representative quenched 5160 steel torsion bar segment using the quenching apparatus and method for hardening steel parts in accordance with the present invention ("direct convection cooling") showing the core of the representative quenched 5160 steel torsion bar segment contains approximately 2.5% bainite.

In the following detailed description of a preferred embodiment of the present invention, reference is made to the accompanying drawings which, in conjunction with this detailed description, illustrate and describe a preferred embodiment of hardening selected steel parts in accordance with the present invention. While the Figures show select representative samples of steel parts which have been hardened using the quenching apparatus and method for hardening steel parts in accordance with a preferred embodiment of the present invention, it will be recognized by those having a level of ordinary skill in the relevant art that other steel parts and steel alloys would also benefit by utilizing the quenching apparatus and method for hardening steel parts in accordance with the preferred embodiment of the present invention described herein.

Referring first to FIGS. 1 through 5, which illustrate a perspective view of a punch made of molybdenum high-speed steel R6M5 (~AISI M2) which has been hardened using the quenching apparatus and method for hardening steel parts in accordance with a preferred embodiment of the present invention ("direct convection cooling"), a top view of an electron photomicrograph of the punch made of molybdenum high-speed steel R6M5 (~AISI M2) which has been hardened using a conventional oil quenching method, a top view of an electron photomicrograph of the punch made of molybdenum high-speed steel R6M5 (~AISI M2) which has been hardened using the quenching apparatus and method for hardening steel parts in accordance with a preferred embodiment of the present invention ("direct convection cooling"), a top view of an electron photomicrograph of the punch made of molybdenum high-speed steel R6M5 (~AISI M2) which has been hardened using a conventional oil quenching method after 5,000 cycles of fatigue testing and a top view of an electron photomicrograph of the punch made of molybdenum high-speed steel R6M5 (~AISI M2) which has been hardened using the quenching apparatus and method for hardening steel parts in accordance with a preferred embodiment of the present invention ("direct convection cooling") after 16,500 cycles of fatigue testing, the quenching apparatus and method for hardening steel parts in accordance with a preferred embodiment of the present invention ("direct convection cooling") described herein is based on the selection of a quenchant material circulation rate which results in an optimal depth of the hardened surface layer, additional steel strengthening, maximum residual surface compressive stresses and an increase in the service life of such hardened steel parts. This is accomplished by using a steel quenching method which includes steel part heating, followed by "direct convection cooling" until the appearance of maximum compressive stresses on the surface, and then tempering.

The "direct convection cooling" is accomplished by a quenchant solution heat transfer rate determined from the following formula:

$$Bi \geq \frac{2(\vartheta_0 - \vartheta_1)}{\vartheta_{Hed} + \vartheta_1}$$

where $$Bi = \frac{hR}{\lambda}$$

The Biot number, a dimensionless value;

h=The heat transfer coefficient;

λ=The thermal conductivity;

D=2R The characteristic size of the part (diameter, thickness of plate, etc.; R is the radius);

$\theta_0 = T_0 - T_K$;

$T_0$=The austenization temperature;

$T_K$=The quenchant boiling temperature;

$\theta_1$=The superfluous temperature at the beginning of "the self-regulated thermal process" (nucleate boiling);

$\theta_{Hed} = T_K - T_C$; and $T_C$=The temperature of the quenching bath.

The time to interrupt the quench such that surface compressive stresses in the steel parts being hardened are at their maximum is calculated using the formula:

$$\tau = \frac{K}{aKn}(b + 0.24k)$$

where

K=The Kondratjev form coefficient;

Kn=The Kondratjev number ($0.6 \leqq K_n \geqq 1$);

a=The thermal diffusivity;

b=A parameter dependent on the austenizing temperature of the steel parts being hardened and the cooling medium temperature;

k=1, 2 or 3 for plate-shaped, cylinder-shaped or ball-shaped bodies, respectively;

$$b = I_n \frac{T_0 - T_C}{T_{Core} - T_C};$$

and $T_{Core}$=The core temperature

In applying this formula, in most cases, the "core" temperature can be estimated to be approximately 450° C., or alternately, in the range of 400° C. to 450° C., and this temperature can be further characterized, if desired, by experimentation. If one applies this formula to calculate the heat transfer rate for the requisite time, the depth of hardening of the steel parts will be in the range of one percent (1%) of the part cross-sectional thickness to all of the way through the steel parts depending on the composition of the steel and the configuration and size of the steel parts being hardened. The rate of "direct convection cooling" should be maintained until cooling is interrupted in the time frame calculated by the above formula. If the timing of interrupting the quench of the steel parts being hardened is off from the time prescribed by the above formula, the level of surface compressive stresses in the steel parts being hardened will be less than the potential "maximum" level of surface compressive stresses possible for the steel parts being hardened.

One advantage of the quenching apparatus and method for hardening steel parts in accordance with the present invention is that a variety of steel materials can be hardened, including alloy and non-alloy steels, high carbon steels, medium carbon steels and even low carbon steels. When the present quenching apparatus and method for hardening steel parts is used, the optimum depth of the hardened surface layer is achieved and maximum surface compressive stresses are formed. If the depth of the hardened surface layer is either greater or less than the optimum as calculated by the present method, the surface compressive stresses are lower and part characteristics are not optimized. The creation of conditions to reach maximum surface compressive stresses yields greater strengthening (as compared to known prior art steel part quenching methods).

In the compressed surface layer during the quench process, martensite transformations occur. Due to the greater specific volume of martensite plates, as compared to the resulting phases, the plastic deformation of austenite occurs which is located between these martensite plates. The higher the compressive surface stresses in the layer being hardened and the higher the cooling rate in the martensite area, the greater the deformations is in the austenite (which positioned between martensite plates). In applying the present invention, martensite plates function like "microhammers" resulting in high density dislocations under high pressure. When the cooling rate is sufficiently rapid, as in "direct convection cooling," these high density dislocations are "frozen" in the steel material.

A similar effect can be obtained through the use of cold working mechanical processes, such as shot peening. After this treatment the hardened steel material will have higher mechanical and plastic properties in comparison with known traditional heat treatment hardening processes. Thus, the optimal depth of the quenched layer is necessary for not only reaching maximum compressive surface stresses, but also for the formation of optimal conditions under which the effect of additional steel material strengthening (greater than normal steel strength) can be realized in full. The additional strengthening (greater than that material's normal strength) of the steel material and high compressive stresses in the surface layer quenched, also results in an increase in the service life of the steel parts and less quench distortion.

Thus, while a prior method of steel quenching proposed cooling of alloy steels within the range of $0.6 \leqq Kn \leqq 1$, where Kn is the Kondratjev number, the quenching apparatus and method for hardening steel in accordance with the present invention utilizes cooling of different steel materials with the determination of cooling parameters by the formula:

$$Bi \geq \frac{2(\vartheta_0 - \vartheta_1)}{\vartheta_{Hed} + \vartheta_1}$$

where $$Bi = \frac{hR}{\lambda}$$

The Biot number, a dimensionless value;

h=The heat transfer coefficient;

$\lambda$=The thermal conductivity;

D=2R The characteristic size of the part (diameter, thickness of plate, etc.; R is the radius);

$\theta_0 = T_0 - T_K$;

$T_0$=The austenization temperature;

$T_K$=The quenchant boiling temperature;

$\theta_1$=The superfluous temperature at the beginning of "the self-regulated thermal process" (nucleate boiling);

$\theta_{Hed} = T_K - T_C$; and $T_C$=The temperature of the quenching bath.

which has the effect of "direct convection cooling," where "the self-regulated thermal process" does not occur. This results in energy savings and greater than normal steel strength for the steel parts.

While a prior art method of steel quenching proposes interrupting cooling at the moment of the formation of optimal depth of the hard layer and reaching maximum surface compressive stresses, the quenching apparatus and method for hardening steel parts in accordance with the present invention, by using "direct convection cooling," allows the use of standard carbon steel materials, as well as alloy steel materials, and, at the same time, provides additional strengthening.

Referring to FIGS. 6 through 13, FIGS. 6 through 9 show a top view of the microstructure of a representative quenched steel part using a conventional oil hardening method showing the surface of the representative quenched steel part contains approximately 3% bainite; a top view of the microstructure of a representative quenched steel part using a conventional hardening method showing the near surface of the representative quenched steel part contains approximately 5% bainite; a top view of the microstructure of a representative quenched steel part using a conventional oil hardening method showing the one half (½) radius of the representative quenched steel part contains approximately 12% bainite; and a top view of the microstructure of a representative quenched steel part using a conventional hardening method showing the core of the representative quenched steel part contains approximately 29% bainite, respectively.

In contrast, referring to FIGS. 10 through 13, which show a top view of the microstructure of a representative quenched steel part using the quenching apparatus and method for hardening steel parts in accordance with the present invention showing the surface of the representative quenched steel part contains approximately 0% bainite; a top view of the microstructure of a representative quenched steel part using the quenching apparatus and method for hardening steel parts in accordance with the present invention showing the near surface of the representative quenched steel part contains approximately 0% bainite; a top view of the microstructure of a representative quenched steel part using the quenching apparatus and method for hardening steel parts in accordance with the present invention showing the one half (½) radius of the representative quenched steel part contains approximately 2% bainite; and a top view of the microstructure of a representative quenched steel part using the quenching apparatus and method for hardening steel parts in accordance with the present invention showing the core of the representative quenched steel part contains approximately 2.5% bainite, respectively. Therefore, steel parts hardened using the quenching apparatus and method for hardening steel parts in accordance with the present invention have a low percentage of bainite in their cross-sections and the high percentage of martensite will enhance the strength of the steel part as compared to conventional oil quenching.

Figure 14:
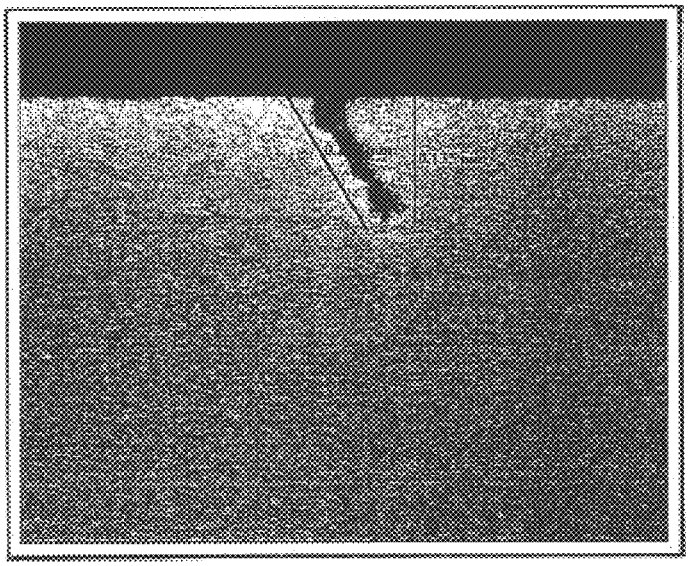
FIG. 14 is a side view of a transverse microsection of a representative quenched 5160 steel torsion bar segment hardened using the quenching apparatus and method for hardening steel parts in accordance with the present invention ("direct convection cooling") taken approximately through one end of the seam.
Figure 15:
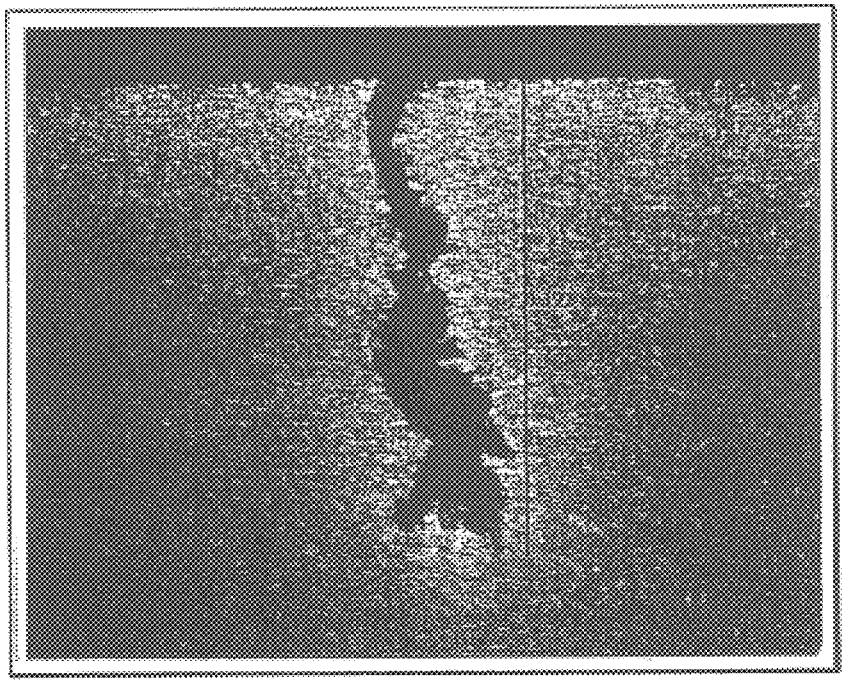
FIG. 15 is a side view of an enlarged transverse microsection of a representative quenched 5160 steel torsion bar segment hardened using the quenching apparatus and method for hardening steel parts in accordance with the present invention ("direct convection cooling") taken approximately through the center of the seam.
Figure 16:
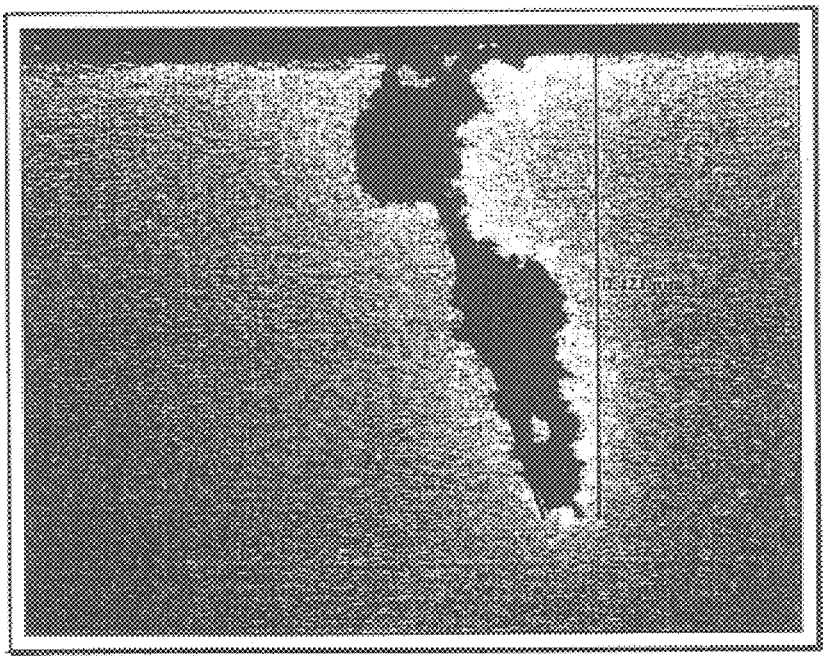
FIG. 16 is a side view of an enlarged transverse microsection of a representative quenched 5160 steel torsion bar segment hardened using the quenching apparatus and method for hardening steel parts in accordance with the present invention ("direct convection cooling") taken approximately through the end of the seam.

Referring to FIGS. 14 through 16, which show a side view of a transverse microsection of a representative quenched steel part hardened using the quenching apparatus and method for hardening steel parts in accordance with the present invention taken approximately through one end of the seam in a representative quenched steel part hardened using the quenching apparatus and method for hardening steel parts in accordance with the present invention fabricated from a 5160H steel alloy; a side view of an enlarged transverse microsection of a representative quenched steel part using the quenching apparatus and method for hardening steel parts in accordance with the present invention taken approximately through the center of the seam in a representative quenched steel part hardened using the quenching apparatus and method for hardening steel parts in accordance with the present invention fabricated from a 5160H steel alloy; and a side view of an enlarged transverse microsection of a representative quenched steel part using the quenching apparatus and method for hardening steel parts in accordance with the present invention taken approximately through the end of the seam in a representative quenched steel part hardened using the quenching apparatus and method for hardening steel parts in accordance with the present invention fabricated from a 5160H steel alloy, respectively. There is no evidence of quench cracks in these microsections. In contrast, with conventional oil quenching, the tensile stresses would have "opened the seams" and the steel parts would have "cracked."

The quenching apparatus and method for hardening steel parts in accordance with the present invention is illustrated in the following examples:

EXAMPLE 1

Rods approximately 40 mm in diameter fabricated from a 14KhGSN2MA-Sh steel containing approximately 0.15% carbon, 1.2% chromium, 1.95% nickel, 1.0% manganese, 0.63% silicon and 0.35% molybdenum are nitrocarburized at 850° C.±10° C. for eight (8) hours. The depth of the nitrocarburized layer in the standard specimen is 0.80 mm. The part was quenched in oil M-20 at 125° C., cryogenically frozen, and thereafter tempered at 250° C. for two (2) hours.

As a result of using the quenching apparatus and method for hardening steel parts in accordance with the present invention, the time of nitrocarburizing can be reduced to four (4) hours (one half (½) of the conventional nitrocarburizing time). Quenching was done in water jets at 18° C., resulting in a nitrocarburizing depth Δδ=0.4 millimeters, which was found to be optimal in experimental data. That means that nitrocarburizing time (and cost) may be reduced by up to 50% and still obtain the optimal steel part properties by using "direct convection cooling." To provide "direct convection cooling" and eliminate "the self-regulated thermal process," the cooling conditions were set as follows:

$$Bi = \frac{2(750^\circ\text{ C.}-\vartheta_1)}{82^\circ\text{ C.}+\vartheta_1},$$

$$\text{where } \vartheta_1 = \frac{1}{\beta}\left[\frac{2\lambda(750^\circ\text{ C.}-\vartheta_1)}{R}\right]^{0.3} = \frac{1}{3}\left[\frac{2\cdot 20(750^\circ\text{ C.}-\vartheta_1)}{0.02}\right]^{0.3};$$

The equation is true when $\theta_1$=23.5° C.;

Here β=3; $\theta_0$=850° C.−100° C.=750° C.; R=0.02 m; λ=20 W/mK $\theta_{Hed}$=82° C.

$$\text{Then } Bi = \frac{2(750^\circ\text{ C.}-23.5^\circ\text{ C.})}{82^\circ\text{ C.}+23.5^\circ\text{ C.}} = 13.8.$$

The convection heat transfer coefficient is equal to $$\alpha_{conv} = \frac{13.8\cdot 40\frac{W}{m\cdot K}}{0.02\,m} = 27545\frac{W}{m^2\cdot K}.$$

These calculated values can be obtained if the gauge pressure in the sprayer is greater than one (1) atmosphere. The surface compressive stresses that are both maximum quantity and optimal depth are obtained when the temperature of the matrix becomes equal to 400° C. Accordingly, it is necessary to interrupt the process of cooling at this moment.

The time of core cooling from 850° C. to 400° C. is calculated as follows:

$$\tau = \left[0.48 + \ln\frac{850^\circ\text{ C.}-18^\circ\text{ C.}}{400^\circ\text{ C.}-18^\circ\text{ C.}}\right]\frac{4\cdot 10^{-4}\cdot 10^6}{5.783\cdot 5.35\cdot 0.93}.$$

$$\text{Where } \Omega = 0.48;\ K = \frac{R^2}{5.783} = \frac{4\cdot 10^{-4}m^2}{5.783};$$

$$a = 5.35\times 10^{-6}\frac{m^2}{s};\ Kn = 0.93.$$

$$\text{Since } Bi_v = \frac{27545\cdot 4\cdot 10^{-4}m^2\cdot 2}{20\cdot 5.783\cdot 0.02} = 9.6;$$

the cooling time is as follows:

$$\tau = [0.48 + 0.778]\frac{400\,m^2}{5.783\cdot 5.35\cdot 0.93} = 17.5s$$

It follows that the steel part should be "direct convection cooled" within the range of seventeen (17) to eighteen (18) seconds. After the cooling has been interrupted and the temperature on the section has become equal, the part is tempered at 250° C. for one (1) hour.

As a result of using the quenching apparatus and method for hardening steel parts in accordance with the present invention, the time of nitrocarburizing time can be reduced to four (4) hours, one half (½) of the time for conventional nitrocarburizing methods, it is no longer necessary to use costly cryogenic treatment, the time of tempering is reduced significantly, it is no longer necessary to use oil (MC-20) as a quenchant material, and the labor efficiency increases.

EXAMPLE 2

Heavy truck half-axles approximately 62 millimeters in diameter fabricated from a 40KhN2MA-Sh (4140) steel were quenched in a high velocity water flow to an optimal depth satisfying the specification calculated as follows:

$$\frac{\Delta\delta}{D} = 0.075.$$

At the same time the core is also hardened. For this purpose, half-axles are thoroughly heated with induction coils to 870° C. and then are cooled in the air to below $A_{C1}$, and then the surface layer is reheated to a depth of 4.65 millimeters, which satisfies the correlation 4.65 millimeters/62 millimeters≈0.075, and then the half-axles are cooled in a high velocity water flow.

The quenchant solution flow rate in the quench chamber is calculated on the basis of the following condition:

$$Bi = \frac{2(\vartheta_0 - \vartheta_1)}{\vartheta_{Hed} + \vartheta_1},$$

$$\text{where } \vartheta_1 = \frac{1}{\beta}\left[\frac{2\lambda(\vartheta_0 - \vartheta_1)}{R}\right]^{0.3}$$

For water at 20° C. we have:

$\beta$=2.95; $\theta_0=T_0-T_K$=870° C.−100° C.=770° C.; $\lambda$=22 W/mK; R=0.031 m; $T_C$=20° C.

Substituting these values into the formulas above, we obtain:

$$\vartheta_1 = 21.8^\circ \text{ C.}; Bi = \frac{2(770^\circ \text{ C.} - 21.8^\circ \text{ C.})}{80^\circ \text{ C.} + 21.8^\circ \text{ C.}} = 14.7.$$

To make Biot equal to 14.7, it is necessary for the convection heat transfer coefficient to be equal to:

$$\alpha_{conv} = \frac{14.7 \cdot \lambda}{R} = \frac{14.7 \cdot 22 \frac{W}{m \cdot K}}{0.031\, m} = 10432 \frac{W}{m^2 \cdot K}$$

This can be obtained using a flow rate of 2.5 meters per second at a clearance of the annulus of 0.02 meters. The convection heat transfer coefficient at the turbulent flow in the annulus is determined by the formula:

$$Nu = 0{,}023\left(\frac{D_2}{D_1}\right)^{0{,}45} Re^{0{,}8} Pr^{0{,}4}.$$

where:

Nu=a Nusselt number;

Re=a Reynolds number; and

Pr=a Prandle number

As a result of using the quenching apparatus and method for hardening steel parts in accordance with the present invention, water was substituted for oil, the service life of the half-axles at cyclical loads increased by approximately ten (10) times and the labor became significantly more efficient.

EXAMPLE 3

Axles approximately thirty (30) millimeters in diameter fabricated from 1045 steel having an optimal specified depth of the hardened layer satisfying the equation:

$$\frac{\Delta\delta}{D} = 0.075, \text{ that is } \Delta\delta = 2.25 \text{ millimeters}$$

$$Bi = \frac{2(\vartheta_0 - \vartheta_1)}{\vartheta_{Hed} + \vartheta_1} = \frac{2(770^\circ \text{ C.} - \vartheta_1)}{80^\circ \text{ C.} + \vartheta_1},$$

$$\text{where } \vartheta_1 = \frac{1}{2{,}95}\left[\frac{2 \cdot 22(770^\circ \text{ C.} - \vartheta_1)}{0.015\, m}\right]^{0.3}$$

It follows that $\theta_1$=27° C.

Substituting the value found to the previous formula, we obtain:

$$Bi = \frac{2(770^\circ \text{ C.} - 27^\circ \text{ C.})}{80^\circ \text{ C.} + 27^\circ \text{ C.}} = 13.9.$$

To achieve "direct convection cooling" and obtain the effect of greater than normal steel strength, it is necessary to arrange the convection heat transfer coefficient to be equal to:

$$\alpha_{conv} = \frac{13.9 \cdot 22 \frac{W}{m \cdot K}}{0{,}015\, m} = 20369 \frac{W}{m^2 \cdot K}.$$

This condition can be obtained using a quenchant material flow rate of six (6) meters per second.

As a result of using the quenching apparatus and method for hardening steel parts in accordance with the present invention, 40KhN2MA alloy steel has been replaced with less expensive 1045 steel, the service life increased by approximately ten (10) times, the ecological conditions (substituting water for oil quench) are improved and the labor became more efficient.

EXAMPLE 4

A stamped steel part approximately 100 millimeters in diameter and 120 millimeters high fabricated from ShKh4 (52100) alloy steel is heated to 860° C. and cooled by water flow at 15° C. The cooling conditions are determined by the formula:

$$Bi \geq \frac{2(\vartheta_0 - \vartheta_1)}{\vartheta_{Hed} + \vartheta_1} \approx 7.5.$$

$$\text{It follows that } \alpha_{conv} = \frac{7.5 \cdot 20 \frac{W}{m \cdot K}}{0.05\, m} = 3000 \frac{W}{m^2 \cdot K}.$$

This can be accomplished if the quenchant solution flow rate in the channel is 0.5 meters per second with a clearance of the annulus of sixty (60) millimeters.

Central points of the steel part are cooled at 280° C. and when reaching this temperature the cooling is interrupted and the steel part is tempered for approximately two (2) hours. The optimal depth of the hardened layer after cooling was approximately 25 millimeters, enhancing steel part performance and substituting water for oil in the quench process.

EXAMPLE 5

A punch approximately 30 millimeters in diameter fabricated from R6M5 (~AISI M2) alloy steel is heated in a salt bath to approximately 1180° C. and cooled by water flow to approximately 20° C. The quenchant solution flow rate is determined by using the formula:

$$Bi \geq \frac{2(1160 - \vartheta_1)}{80 \div \vartheta_1}, \text{ where}$$

$$\vartheta_1 = \frac{1}{3}\left[\frac{2 \cdot 20(1160^\circ \text{ C.} - \vartheta_1)}{0.015}\right]^{0.3} \approx 30^\circ \text{ C.}$$

or Bi≧20, It follows that:

$$\alpha_{conv} = \frac{20 \cdot 20 \frac{W}{m \cdot K}}{0.015} = 26666 \frac{W}{m^2 \cdot K}$$

This can be accomplished if the quenchant material flow rate is approximately eight (8) meters per second. In the conditions, the punch is cooled for approximately twelve (12) seconds until reaching maximum compressive surface stresses, which is calculated by the formula:

$$\tau = \left[0.48 + \ln\frac{1180-20}{450-20}\right]\frac{3.9\cdot 10^{-5}}{0.86\cdot 5.6\cdot 10^{-6}} \approx 12s,$$

where Kn=0.86, a=5.6×10$^{-6}$ m$^2$/s; K=3,9×10$^{-5}$ m$^2$.

After this, normal tempering cycles are performed three (3) times. At the first step, the isothermal heating and tempering are performed simultaneously.

Properties of quenched and tempered steels hardened using conventional hardening methods and the quenching apparatus and method for hardening steel parts in accordance with the present invention are compared in Table 1 below:

TABLE 1

Properties of quenched and tempered steels

| Quenching method | Cooling rate, V, ° C./s | Steel[1] | Tensile strength, $R_{ms}$MPa | Yield strength, $R_{p0.2,}$MPa | Elongation, A, % | Reduction in area, Z, % |
|---|---|---|---|---|---|---|
| Oil(Conventional) | 6 | Y7A | 1400 | 1250 | 4.0 | — |
| | | 60C2A | 1476 | 1355 | 8.5 | — |
| Polymer and Salt Solution | 10 | Y7A | 1460 | 1370 | 7.8 | 22 |
| | | 60C2A | 1420 | 1260 | 8.2 | 26 |
| "Direct Convection Cooling" | 30 | Y7A | 1610 | 1570 | 7.9 | 31 |
| | | 60C2A | 1920 | 1740 | 5 | 22 |

[1]Steel Y7A tempered 2h at 360–370° C. Steel 60C2A tempered 2h at 460° C.

The above table appeared in a paper titled "Part IV Basics of Intensive Quenching" authored by the inventor and published in the December 1999, issue of "Advanced Materials & Processes," Volume 156, Number 6, page H33.

In addition, the tool life of M-2 steel punches in an automatic forming machine hardened using conventional hardening methods and the quenching apparatus and method for hardening steel parts in accordance with the present invention ("direct convection cooling") are shown in Table 2 below:

TABLE 2

Tool life of punches in automatic forming machine[1]

| Test No. | Durability,[2] no. of strokes: Existing technology | Durability,[2] no. of strokes: Intensive quenching | Increase in tool life,[3]X |
|---|---|---|---|
| 1 | 6460 | 15,600 | 2.4 |
| 2 | 6670 | 16,500 | 2.5 |
| 3 | 3200 | 5300 | 1.65 |
| 4 | 4000 | 12,075 | 3.0 |
| 5 | 6620 | 8110 | 1.2 |
| 6 | 2890 | 10,500 | 3.6 |
| 7 | 2340 | 7300 | 3.1 |

[1]Machine capacity: 175 strokes/min.
[2]Number of strokes until tool wore out.
[3]Increase in tool life due to intensive quenching.

The above table appeared in a paper titled "Part IV Basics of Intensive Quenching" authored by the inventor and published in the December 1999, issue of "Advanced Materials & Processes," Volume 156, Number 6, page H33.

The carbon content of the steel alloy affects the percentage of martensite formed. The deformation effect is due to work hardening and/or the speed of cooling. The martensite start temperature and/or prior deformation can lower the stress effect and driven martensite formation. Plastically deformed austensite causes more nucleates for martensite, thus decreasing the packet size and creating fine martensite plates.

Referring to FIGS. 2 through 5, steel parts hardened using the quenching apparatus and method for hardening steel parts in accordance with the preferred invention as disclosed herein have a packed matensitic structure with a "plate" or "needle" morphology. This martensitic structure is characterized by a higher percentage of martensite relative to austenite following the initial quench (as compared to known prior art steel part quenching methods). In addition, steel parts hardened using the quenching apparatus and method for hardening steel parts in accordance with the present invention have surface compressive stresses or higher levels of surface compressive stresses (as compared to known prior art steel part quenching methods). These surface compressive stresses can be in the range of 100 MPa to 1,200 MPa, which is on the same order of magnitude as presently achieved using cold working processes, such as shot peening. However, the surface compressive stresses are "driven" in more deeply, up to approximately two (2) millimeters, into the steel parts as compared to cold working processes. In addition, steel parts hardened using the quenching apparatus and method for hardening steel parts in accordance with the present invention have greater than seven percent (7%), and up to forty percent (40%), and most often in the range of ten percent (10%) to twenty five percent (25%), increase in yield strength and tensile strength (as compared to known prior art steel part quenching methods).

In addition to the high surface compressive stresses achieved in steel parts using the quenching apparatus and method for hardening steel parts in accordance with the present invention, such steel parts also have reduced distortion and cracking (as compared to known prior art steel part quenching methods). The tool life of steel parts hardened using the quenching apparatus and method for hardening steel parts in accordance with the present invention has been shown to be increased from one and one half (1½) to ten (10) times and the impact strength or toughness is increased in the range of fifty percent (50%) to three hundred percent (300%) due to these improved properties, and better core conditioning of the steel parts (as compared to known prior art steel part quenching methods) is also obtained.

Thus, steel parts which have been hardened using "direct convection cooling" in accordance with the quenching apparatus and method for hardening steel parts in accordance with the present invention have denser, tighter layers of martensite packets (packed martensite) and higher deformation effects from the higher surface compressive stresses. This packed martensite structure and higher surface compressive stresses generally provide greater strength and durability for steel parts hardened using the quenching apparatus and method for hardening steel parts in accordance with the present invention (as compared with known prior art steel part quenching methods).

The quenching apparatus for hardening steel parts in accordance with the present invention can provide "direct convection cooling" for the steel parts in several ways: including rapid or cyclic immersion with or without quenching solution agitation, quenching solution spray, impingement jets, high flow of the quenching solution, gravity feed of the quenching solution and the quenching solution being maintained under pressure to increase the boiling point of the quenching solution. In addition, the quenching apparatus for hardening steel parts in accordance with the present invention generally includes a container to retain the quenching solution and can also include one or more of the following: a conveyor belt to move the steel parts relative to the quenching solution, a mechanism for spinning the steel parts relative to the quenching solution and/or one or more pumps or props to circulate the quenching solution relative to the steel parts. The quenching solution is preferably water or water based solutions and can be used with or without additives, such as polymer based additives, which effect the boiling rate. In addition, particulate additives, such as small copper powder, can be used in the quenching solution, if desired, to assist in breaking up and precluding boiling on the surface of the steel parts.

In summary, as seen in the above examples, the quenching apparatus and method for hardening steel parts in accordance with the present invention provides several advantages over known prior art steel quenching methods. In particular, the quenching apparatus and method for hardening steel parts in accordance with the present invention allows steel parts fabricated from standard carbon steels to benefit from the effect of greater than normal steel strength and high surface compressive surface stresses. Also, if desired, alloy steels and high alloy steels can be replaced with standard carbon steels or low-alloy steels having an optimal depth of a hardened layer and a ductile core. In this case, the effect of greater than normal steel strength is obtained for the particular grade of steel and the service life of such steel parts are increased. The quenching apparatus and method for hardening steel parts also allows the use of quenchant materials which are water or water based, rather than oil based quenchant materials, which are relatively expensive, flammable and potentially environmentally harmful. In addition, the labor efficiency is increased and the state of the environment is improved (simplified parts washing and elimination of smoke and oil residues) when using the quenching apparatus and method for hardening steel parts in accordance with the present invention.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A method of hardening steel parts by heat treatment comprising the steps of:

a) Heating the steel parts throughout to a temperature in excess of the austenite start temperature of the steel parts; and b) Quenching the steel parts in a quenching solution in a manner such that the occurrence of both film boiling and the self-regulated thermal process is avoided at all times during the quenching process.

2. The method of hardening steel parts by heat treatment in accordance with claim 1, further including the step of interrupting the quenching process in order to maximize the magnitude and depth of compressive stresses in the steel parts following the step of quenching the steel parts in a quenching solution in a manner such that the occurrence of both film boiling and the self-regulated thermal process is avoided at all times during the quenching process.

3. The method of hardening steel parts by heat treatment in accordance with claim 1, further including the step of interrupting the quenching process at a time derived from formula $$\tau = \frac{K}{aKn}(b + 0.24k)$$

to maximize the magnitude and depth of compressive stresses in the steel parts following the step of quenching the steel parts in a quenching solution in a manner such that the occurrence of both film boiling and the self-regulated thermal process is avoided at all times during the quenching process.

4. The method of hardening steel parts by heat treatment in accordance with claim 1, wherein the quenching solution is a water based quenching solution.

5. The method of hardening steel parts by heat treatment in accordance with claim 1, further including the step of tempering the steel parts following the step of quenching the steel parts in a quenching solution in a manner such that the occurrence of both film boiling and the self-regulated thermal process is avoided at all times during the quenching process.

6. The method of hardening steel parts by heat treatment in accordance with claim 5, wherein the step of tempering the steel parts following the step of quenching the steel parts in a quenching solution in a manner such that the occurrence of both film boiling and the self-regulated thermal process is avoided at all times during the quenching process consists of self tempering the steel parts at room temperature.

7. The method of hardening steel parts by heat treatment in accordance with claim 5, wherein the step of tempering the steel parts following the step of quenching the steel parts in a quenching solution in a manner such that the occurrence of both film boiling and the self-regulated thermal process is avoided at all times during the quenching process consists of tempering the steel parts in a furnace at a temperature in the range of about 150° C. to 600° C.

8. A heat treated steel part, comprising a microstructure having a packed martensitic structure with a plate or needle morphology, and having surface compressive stresses of about 100 MPa to 1200 MPa and exhibiting an increase of about 7 to 40% in yield strength and tensile strength as compared to steel parts that have been hardened by other quenching methods.

9. An apparatus for heat treating steel parts, comprising a container having quenching solution therein, and means causing the flow velocity of said quenching solution in said container to be sufficient to prevent film or nucleate boiling on the surface of the steel parts at all times during the quenching process.

10. The apparatus for heat treating steel parts in accordance with claim 9, wherein the steel parts are immersed in said quenching solution and said quenching solution flow velocity causing means agitates said quenching solution in said container.

11. The apparatus for heat treating steel parts in accordance with claim 9, wherein said quenching solution flow velocity causing means sprays said quenching solution onto the steel parts.

12. The apparatus for heat treating steel parts in accordance with claim 9, wherein said quenching solution flow velocity causing means comprises impingement jets.

13. The apparatus for heat treating steel parts in accordance with claim 9, wherein said quenching solution flow velocity causing means maintains the flow velocity of said quenching solution at a relatively high flow rate relative to the steel parts.

14. The apparatus for heat treating steel parts in accordance with claim 9, wherein said quenching solution flow velocity causing means comprises a gravity feed device to maintain a relatively high quenching solution flow rate relative to the steel parts.

15. The apparatus for heat treating steel parts in accordance with claim 9, wherein said container is under pressure to increase the boiling point of said quenching solution.

16. The apparatus for heat treating steel parts in accordance with claim 9, wherein said quenching solution is a water based quenching solution.

17. The apparatus for heat treating steel parts in accordance with claim 9, wherein said quenching solution includes a polymer based additive to modify the quenching characteristics of said quenching agent.

18. The apparatus for heat treating steel parts in accordance with claim 9, wherein said quenching solution includes a particulate additive to break up or preclude boiling on the steel parts.

19. The apparatus for heat treating steel parts in accordance with claim 9, wherein said quenching solution is maintained at approximately room temperature.

20. The apparatus for heat treating steel parts in accordance with claim 9, further including a conveyor for moving the steel parts relative to said quenching solution.

21. The apparatus for heat treating steel parts in accordance with claim 9, further including a mechanism for spinning the steel parts relative to said quenching solution.

* * * * *